US006520126B2

(12) United States Patent
Kawamoto

(10) Patent No.: US 6,520,126 B2
(45) Date of Patent: Feb. 18, 2003

(54) CYLINDER HEAD COOLING PASSAGE STRUCTURE OF OVERHEAD CAM TYPE ENGINE

(75) Inventor: Yuichi Kawamoto, Akashi (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 09/771,847

(22) Filed: Jan. 29, 2001

(65) Prior Publication Data

US 2002/0100436 A1 Aug. 1, 2002

(51) Int. Cl.[7] ..... F02F 1/36

(52) U.S. Cl. ..... 123/41.82 R; 123/41.28

(58) Field of Search ..... 123/41.01, 41.08, 123/41.2, 41.21, 41.23, 41.26, 41.28, 41.29, 41.3, 41.39, 54.4, 291, 293, 193.3, 193.4, 193.5, 184.31, 41.41, 41.57, 41.82 R

(56) References Cited

U.S. PATENT DOCUMENTS 5,890,461 A * 4/1999 Iikura ..... 123/41.82 R
6,158,400 A * 12/2000 Collie et al. ..... 123/41.82 R

FOREIGN PATENT DOCUMENTS

| | | |
|---|---|---|
| JP | 56-138444 | 10/1981 |
| JP | 61-197218 | 12/1986 |
| JP | 9-256829 | 9/1997 |
| JP | 10-47057 | 2/1998 |
| JP | 10-030445 | 2/1998 |

* cited by examiner

*Primary Examiner*—Paul J. Hirsch
(74) *Attorney, Agent, or Firm*—Marshall, Gerstein & Borun

(57) ABSTRACT

A cylinder head cooling passage structure comprises: a cylinder head H1; two intake valves 22; and an exhaust valve 32. The two intake valves 22 are provided in the cylinder head H1 such that the intake valves are substantially symmetric with respect to a plane that includes a center axis a1 of a cylinder of an OHC-type engine E and is orthogonal to a crank shaft Cr. The exhaust valve 32 is provided in the cylinder head H1 such that the exhaust valve is situated on an opposite side of the intake valves 22 with respect to a plane that includes the center axis a1 of the cylinder and is in a longitudinal direction of the crank shaft Cr. Intake ports 21 associated with the intake valves 22 and an exhaust port 31 associated with the exhaust valve 32 are formed in the cylinder head H1 such that the intake ports 21 extend in a direction substantially orthogonal to the crank shaft Cr and reach one end side of the cylinder head H1 and the exhaust port 31 extends in the direction substantially orthogonal to the crank shaft Cr and reaches the other end side of the cylinder head H1. A coolant passage 10 is formed in the cylinder head H1, for passing coolant therethrough. The coolant passage 10 has a coolant inflow opening 11 formed in a bottom face of the cylinder head H1 that is joined to a cylinder block of the engine E and a coolant discharge opening 12 formed in an outer face of the cylinder head H1. A water gallery 13 is formed in the coolant passage 10 such that the water gallery 13 communicates with the coolant discharge opening 12, the coolant which has finished heat exchange with the cylinder head H1 being gathered into the water gallery 13. The water gallery 13 is formed above the intake port 21 in the direction of the center axis a1 of the cylinder.

9 Claims, 4 Drawing Sheets

CYLINDER HEAD COOLING PASSAGE STRUCTURE OF OVERHEAD CAM TYPE ENGINE

BACKGROUND OF THE INVENTION

1. Field of the Invention

The present invention relates to a cylinder head cooling passage structure for cooling a cylinder head of an Overhead Cam (hereinafter referred to as "OHC") type engine with a coolant.

2. Description of the Related Art

In general, a cooling passage structure of a water-cooled engine is as follows. Water passages are formed in a cylinder and a cylinder head such that the water passages communicate with each other. Cooling water is fed from the water passage of the cylinder to the water passage of the cylinder head.

FIG. 4 is a transverse sectional view showing an OHC V-type engine disclosed in Japanese Laid-Open Patent Publication No. Hei. 10-47057. A cooling passage structure of the OHC V-type engine includes a water passage 150 formed in a cylinder and a water passage 110 formed in a cylinder head. Cooling water introduced from the water passage 150 of the cylinder to the water passage 110 of the cylinder head passes through a water gallery 113 and is discharged to outside of the cylinder head. A cooling water pipe 100P is connected to a cooling water discharge opening 112 communicating with the water gallery 113 of the cylinder head. The cooling water is introduced into the cooling water pipe 100P and returned to a radiator. The cylinder head is provided with an intake valve and an exhaust valve. An intake port 121 and an exhaust port 131, respectively associated with the intake valve and the exhaust valve, are formed in the cylinder head. The water gallery 113 is situated below the intake port 121.

The water gallery is a space into which the cooling water which has finished heat exchange with the cylinder and the cylinder head is finally gathered. Through the water gallery, the cooling water is discharged to outside of the cylinder head. Accordingly, it is required that the water passage of the cylinder head be designed to allow the cooling water to be gathered into the water gallery as smoothly as possible.

The cooling water or coolant, which has finished heat exchange with the cylinder and the cylinder head, has a low density and tends to move upwardly as the temperature increases. Bubbles can become mixed in the cooling water or coolant. It is therefore desirable to place the water gallery as high as possible in the water passage.

In a desirable cooling passage structure for performing well-balanced cooling of the cylinder head, the cooling water which has cooled high temperature portions such as portions around an ignition plug, an exhaust port, and an exhaust valve, without nonuniform flow of the cooling water, is gathered into the water gallery in the vicinity of the intake port where temperature is relatively low and then discharged to outside. By the way, in the conventional V-type engine shown in FIG. 4, the intake port 121 is placed at a position higher than the position of the exhaust port 131, the water gallery 113 is provided at an uppermost portion of the cooling passage structure in the cylinder head, and the cooling water discharge opening 112 and the cooling water pipe 100P are provided upwardly of the water gallery 113. However, in the cylinder head cooling passage structure of FIG. 4, when an attempt is made to provide the water gallery 113 at a higher position in the flow of the cooling water, the water gallery 113 cannot be placed at a sufficiently higher position because of limitation due to placement of the intake port 121. Still, if the water gallery 113 is forcibly provided at the higher position, the cylinder is made larger and it is difficult that the cylinder head is made compact. When an inclination angle of the cylinder is reduced, it is difficult to provide the water gallery 113 at the uppermost portion of the cooling passage.

When the cooling water discharge opening 112 communicating with the water gallery 113 is formed forwardly or rearwardly of the intake port 121 in the direction orthogonal to the cut-away surface as shown in FIG. 4 rather than immediately below the intake port 121, cooling of the cylinder head becomes ill-balanced.

SUMMARY OF THE INVENTION

Under the circumstances, an object of the present invention is to provide a cylinder head cooling passage structure of an OHC-type engine which is capable of performing well-balanced cooling of a cylinder head, improving cooling efficiency by providing a water gallery at a high position and making the cylinder head compact.

According to the present invention, there is provided a cylinder head cooling passage structure of an overhead cam type engine comprising: a cylinder head; two intake valves; and an exhaust valve, wherein the two intake valves are provided in the cylinder head such that the intake valves are substantially symmetric with respect to a plane that includes a center axis of a cylinder of the engine and is orthogonal to a crank shaft; the exhaust valve is provided in the cylinder head such that the exhaust valve is situated on an opposite side of the intake valves with respect to a plane that includes the center axis of the cylinder and is in a longitudinal direction of the crank shaft, intake ports associated with the intake valves and an exhaust port associated with the exhaust valve are formed in the cylinder head such that the intake ports extend in a direction substantially orthogonal to the crank shaft and reach one end side of the cylinder head and the exhaust port extends in the direction substantially orthogonal to the crank shaft and reaches the other end side of the cylinder head, a coolant passage is formed in the cylinder head, for passing coolant therethrough, the coolant passage has a coolant inflow opening formed in a bottom face of the cylinder head that is joined to a cylinder block of the engine and a coolant discharge opening formed in an outer face of the cylinder head, a water gallery is formed in the coolant passage such that the water gallery communicates with the coolant discharge opening, the coolant which has finished heat exchange with the cylinder head being gathered into the water gallery, and the water gallery is formed above the intake ports in a direction of the center axis of the cylinder.

According to the cylinder head cooling passage structure described above, the water gallery is formed in the cylinder head such that it is situated at a higher position which is on the intake port's side. Therefore, the coolant which has an elevated temperature after finishing heat exchange with the cylinder head and has a tendency to go upwardly, is naturally gathered into the water gallery. Likewise, bubbles mixed into the coolant are naturally gathered into the water gallery.

In addition, since it is not necessary to place the intake port at a higher position for the purpose of placing the water gallery at a higher position, the cylinder head can be compactly designed.

Further, since the coolant discharge opening is formed above the intake port, the position of the coolant discharge opening is not restricted by the intake port. As a result, the coolant discharge opening can be provided at a suitable position.

It is preferable that the water gallery is formed such that it spans the two intake ports, and the coolant passage is formed so that the coolant passes through a portion between the two intake ports and outside of the two intake valves and is gathered into the water gallery, because cooling of the vicinity of the intake port can be well-balanced.

The coolant discharge opening may be formed above the water gallery and on a substantially center line of the two intake valves.

Also, it is preferable that the water gallery is formed between the intake port and a side wall of a chamber formed in the cylinder head for accommodating an upper portion of valve stems of the two intake valves, the side wall being closer to the intake port, because the cylinder head can be more compactly designed.

Moreover, it is preferable that the center axis of the cylinder is inclined such that the intake valves are situated at a position higher than the position of the exhaust valve. Thereby, the water gallery is positioned at a higher position, which enables the coolant with elevated temperature or bubbles to be easily gathered into the water gallery.

These and other aspect and advantages of the invention will become apparent from the following detailed description of preferred embodiments when taken in conjunction with the accompanying drawings.

DETAILED DESCRIPTION OF THE PREFERRED EMBODIMENTS

A cylinder head cooling passage structure according to an embodiment of the present invention will be described with reference to drawings.

Figure 1:
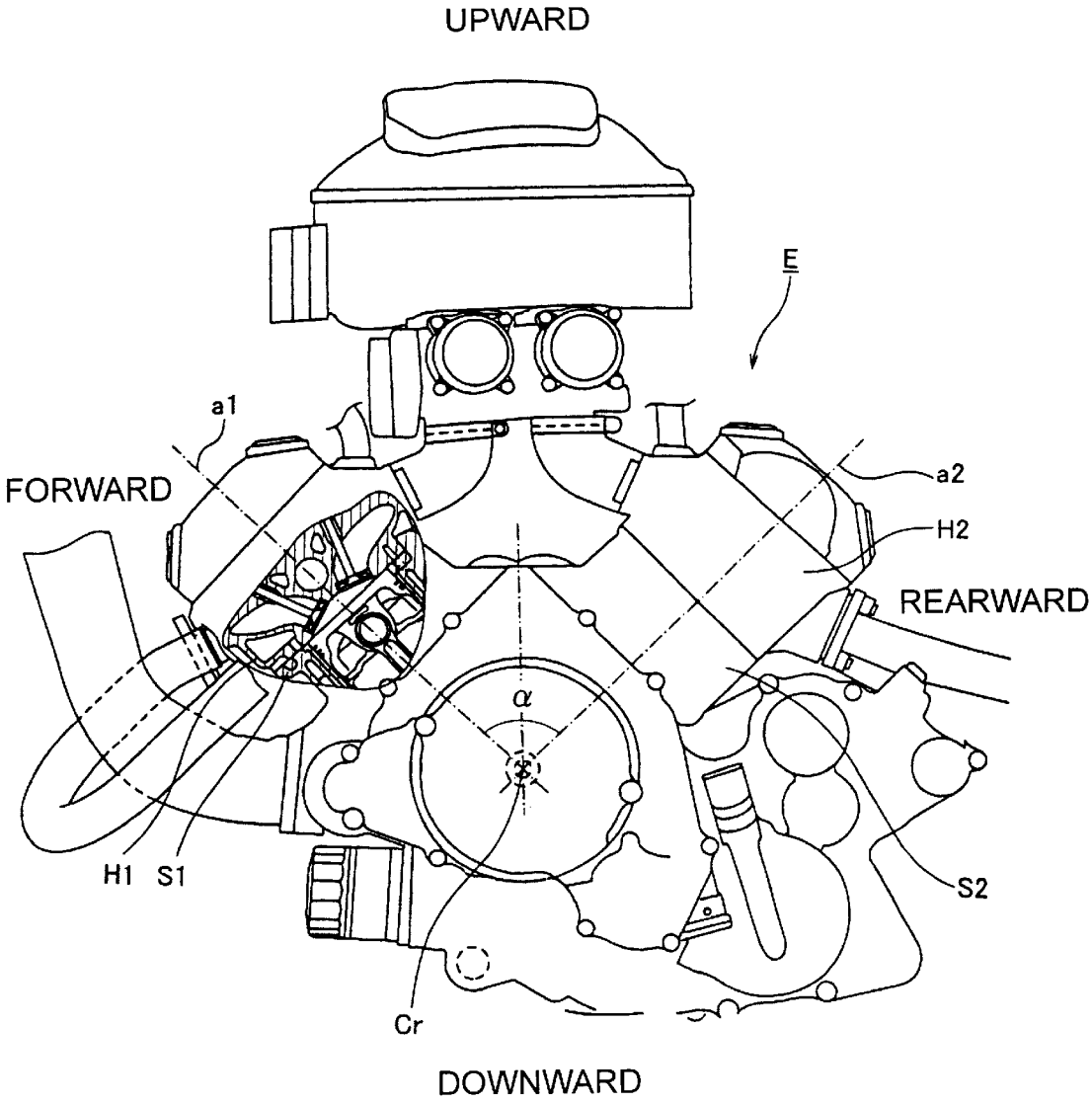
FIG. 1 is a partially sectioned side view showing an OHC-type engine which employs a cylinder head cooling passage structure according to an embodiment of the present invention.

FIG. 1 is a partially sectioned side view showing an OHC-type engine E, in which a partial cross section of a cylinder S1 and a cylinder head H1 which are situated leftward is shown. The OHC-type engine E employs a cylinder head cooling passage structure according to an embodiment of the present invention. The OHC-type engine E is so-called V-twin engine in which the two cylinders S1, S2 are arranged in V-shape. A center axis a1 of the cylinder S1 and a center axis a2 of the cylinder S2 are upwardly extended from a crank shaft Cr as a center with an open angle (bank angle) a in a forward and rearward direction (in a rightward and leftward direction in FIG. 1). A cylinder head H1 and a cylinder head H2 respectively situated forwardly and rearwardly have the same head cooling passage structure. Hereinafter, the head cooling passage structure of the leftward cylinder head H1 will be described.

The partial cross section of the cylinder S1 and the cylinder head H1 in FIG. 1 is a transverse cross section in which a center of the cylinder S1 is sectioned in a direction orthogonal to the crank shaft Cr.

Figure 2:
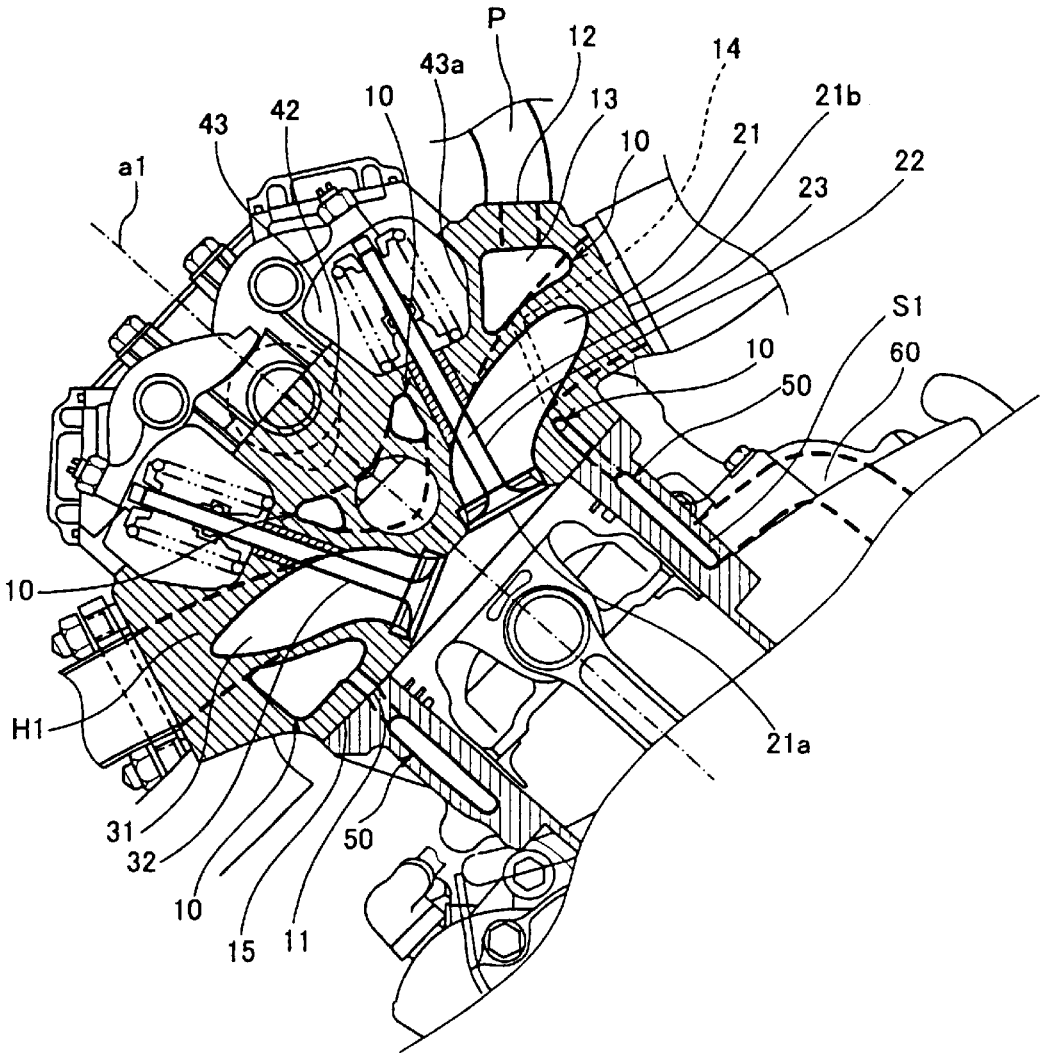
FIG. 2 is an enlarged cross-sectional view showing a cylinder and a cylinder head of the OHC-type engine of FIG. 1.

FIG. 2 is an enlarged view of the transverse cross section of FIG. 1. In FIGS. 1, 2, required portions are perspectively drawn for easy understanding of description.

Two intake valves 22 and two exhaust valves 32 are provided in the cylinder head H1. These four valves 22, 32 are placed in the forward and rearward direction (in the rightward and leftward direction in FIG. 2) such that they are spaced so as to make substantially equal angles with respect to the center axis a1 of the cylinder. In a cylinder head portion S1 shown in FIGS. 1, 2, centers of the intake valve 22 and of the exhaust valve 32 are sectioned (cross-sectional view in the direction of the arrow X—X in FIG. 3). The intake valve 22 and the exhaust valve 32 provided in the cylinder head H1 are opened/closed by a cam 42. In FIG. 2, reference numeral 43 denotes a cam chamber. An upper portion of a valve stem 23 of the intake valve 22 is accommodated in the cam chamber 43.

A water jacket for cooling the cylinder S1 and the cylinder head H1 of the engine E is mainly constituted by a first coolant passage 10 formed in the cylinder head H1 and a second coolant passage 50 formed in the cylinder S1. The head cooling passage structure is mainly constituted by the first coolant passage 10.

A coolant passage 60 is formed in the cylinder S1. The coolant passage 60 communicates with the second coolant passage 50. The coolant is sent into the second coolant passage 50 through the coolant passage 60 by a water pump (not shown). The coolant sent into the second coolant passage 50, after finishing heat exchange with the cylinder S1, passes through a boundary face between the cylinder S1 and the cylinder head H1, and is sent to the cylinder head H1. Then, the coolant finishes heat exchange with the cylinder head H1 in the first coolant passage 10 and is gathered into a water gallery 13 formed in the first coolant passage 10. Leaving the water gallery 13, the coolant passes through the coolant discharge opening 12 and is sent into the coolant pipe P. The coolant pipe P is provided so as to introduce the coolant to a radiator (not shown).

Figure 3:
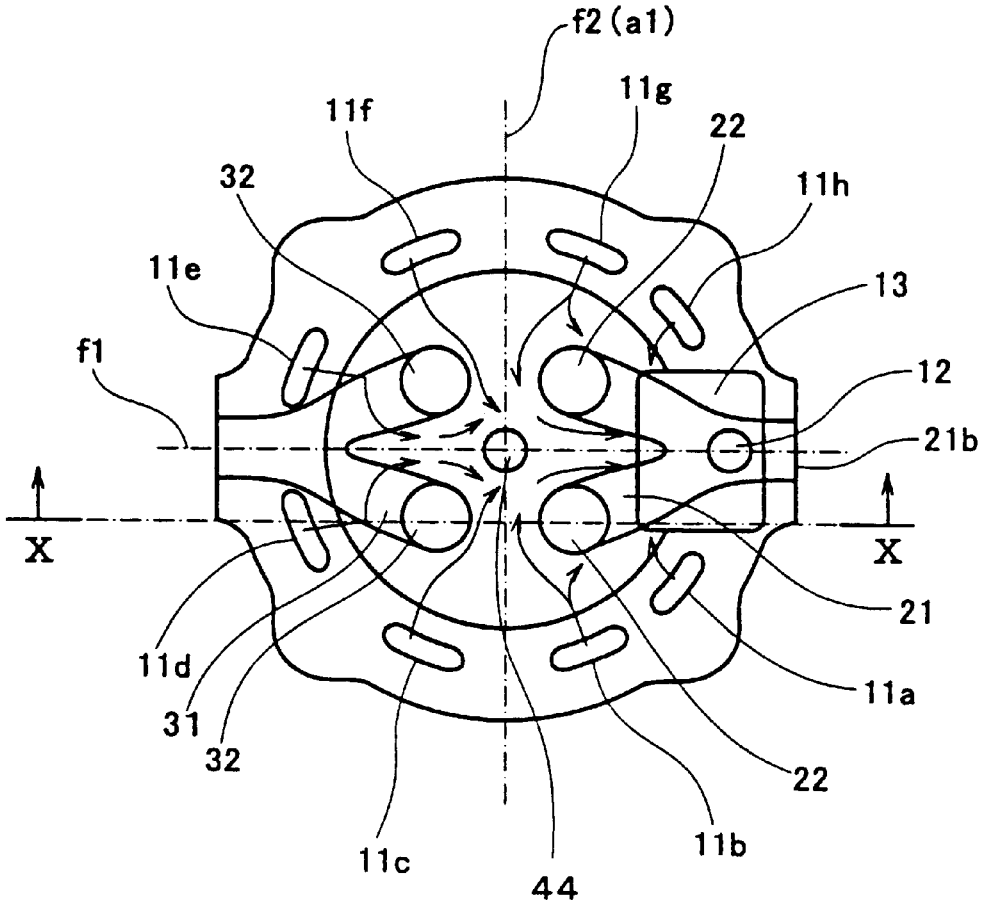
FIG. 3 is a schematic plan view showing flow lines of coolant flowing through a first coolant passage of the OHC-type engine of FIG. 1.
Figure 4:
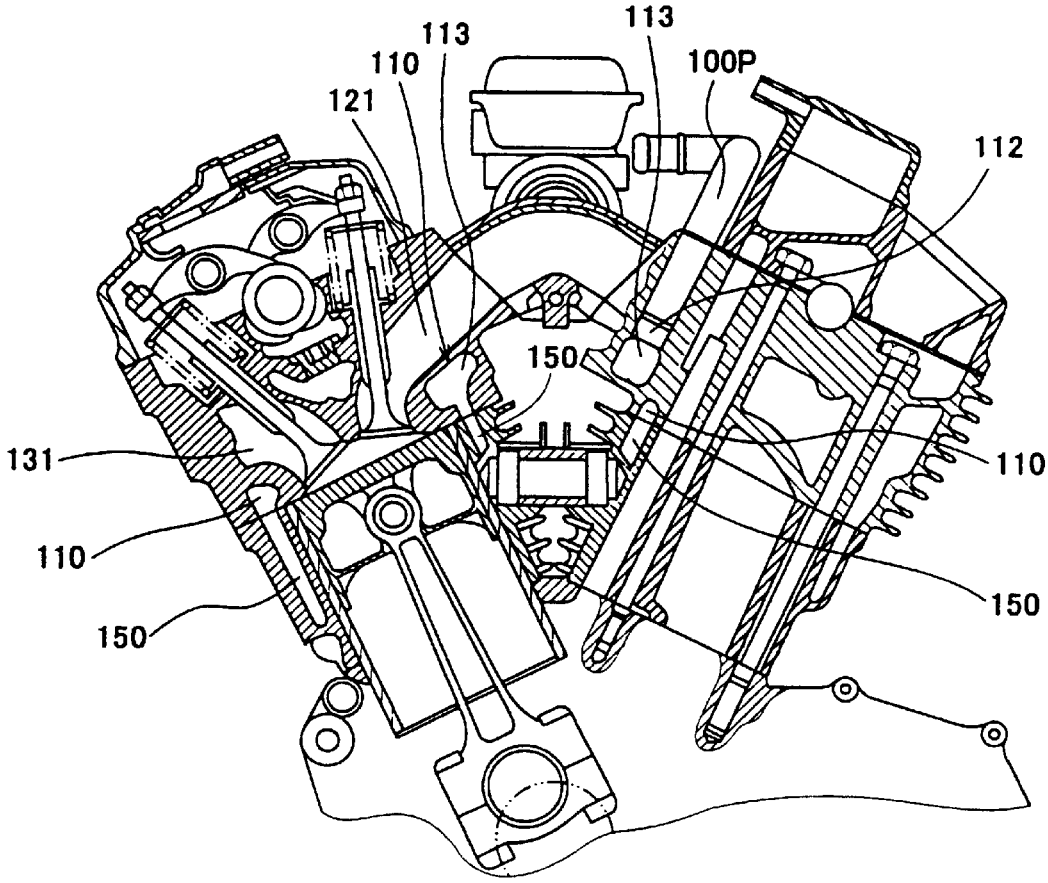
PRIOR ART FIG. 4
FIG. 4 is a cross-sectional view showing an engine which employs the conventional cylinder head cooling passage structure.

FIG. 3 is a schematic plan view showing flow lines of the coolant flowing through the first coolant passage 10, in which the intake ports 21, the intake valves 22, the exhaust ports 31, the exhaust valves 32, the ignition plug 44, and the like are projected on a bottom face of the cylinder head H1. A center line f1 in FIG. 3 is a center line of the cylinder S1 in a direction orthogonal to the crank shaft Cr. A center line f2 in FIG. 3 is a center line of the cylinder S1 in a longitudinal direction of the crank shaft Cr (in a direction of the crank shaft Cr). In the first coolant passage 10 of FIG. 3, to avoid complexity, openings 11*a*–11*h* in the bottom face of the cylinder head H1, the water gallery 13, and the coolant discharge opening 12 are shown and the other parts are omitted. The direction in which the coolant flows through the first coolant passage 10 is conceptually indicated by arrows.

Subsequently, a structure of the first coolant passage 10 will be described in detail with reference to FIGS. 2, 3.

As mentioned previously, the two intake valves 22 and the two exhaust valves 32 are provided in the cylinder head H1. The two intake valves 22 are substantially symmetric with respect to the center line f1 in FIG. 3. Also, the two exhaust valves 32 are substantially symmetric with respect to the center line f1 in FIG. 3.

The intake port 21 and the exhaust port 31 are situated on opposite sides with respect to the center line f2. While the intake port 21 and the exhaust port 31 are placed as being substantially symmetric with respect to the center line f2 in this embodiment, the intake port 21 and the exhaust port 31 are not necessarily placed as being symmetric. Also, while the two exhaust valves 32 are provided in the cylinder head H1 in this embodiment, the number of the exhaust valves is not limited to two and may be one, three or more. The intake port 21 and the exhaust port 31, which are respectively associated with the intake valve 22 and the exhaust valve 32, are formed in the cylinder head H1. The two intake ports 21 communicate with an outer opening 21*b* formed in an outer face of the cylinder head H1. Specifically, two ports branched from the outer opening 2l*b* are formed in the cylinder head H1 and so branched ports respectively function as the intake ports 21. These two intake ports 21 extend along the valve stems 23 of the intake valves 22 from inner openings 21*a* opened in a combustion chamber and are then bent outwardly. Then, the intake ports 21 are united into one port, which extends to the outer opening 21*b* as an intake inlet of the cylinder head H1.

As mentioned previously, the center axis a1 and the center axis a2 of the the center corresponding to the crank shaft Cr. This inclination makes the intake valve 22 situated at a position higher than the position of the exhaust valve 32.

The first coolant passage 10 formed in the cylinder head H1 has a coolant inflow opening 11 through which the coolant is flowed into the first coolant passage 10 and a coolant discharge opening 12 through which the coolant is discharged to outside of the first coolant passage 10.

The first coolant passage 10 is formed in the cylinder head H1 such that it is substantially symmetric with respect to the center line f1. Therefore, the flow lines of the coolant flowing through the first coolant passage 10 are substantially symmetric with respect to the center line f1.

The coolant inflow opening 11 is formed in the bottom face of the cylinder head H1. The coolant inflow opening 11 is constituted by a plurality of openings 11*a*, 11*b*, 11*c*, 11*d*, 11*e*, 11*f*, 11*g*, and 11*h* provided in the bottom face of the cylinder head H1 in a circumferential direction thereof. FIG. 3 shows shapes of the openings 11*a*–11*h*. The bottom face of the cylinder head H1 is a face joined to a top face of the cylinder S1 via a gasket 15. An opening is formed in the top face of the cylinder S1 to discharge the coolant in the second coolant passage 50. The shape of this opening conforms to the shape of the coolant inflow opening 11 of the first coolant passage 10. A hole is formed in the gasket 15 interposed between the cylinder S1 and the cylinder head H1. The shape of this hole conforms to the shape of the coolant inflow opening 11 of the first coolant passage 10.

The coolant inflow opening 11 is constituted by the plurality of openings 11*a*–11*h* and the first coolant passage 10 includes a plurality of f1ow passages. These flow passages starting from the respective openings 11*a*–11*h* in the bottom face of the cylinder head H1 communicate with one another inside of the cylinder head H1 and are finally gathered to the water gallery 13.

Specifically, the first coolant passage 10 is branched into the plurality of flow passages so that the coolant passes through the vicinities of the intake port 21, the exhaust port 31, the ignition plug 44 and the like. These flow passages are finally gathered to the water gallery 13 communicating with the coolant discharge opening 12.

The flow passages of the first coolant passage 10 are formed so that most of the coolant flowing into the first coolant passage 10 first cools high temperature portions such as the exhaust port 31, the exhaust valve 32, the ignition plug, and then flows toward the intake port 21. The coolant which has cooled the high temperature portions, passes through the portion between the two intake ports 21 and outside of the two intake valves 22 and is then introduced to the water gallery 13. In this embodiment, the flow passages extending from the portion of the coolant inflow opening 11 that is close to the intake port 21, through the outside of the intake valve 22, and to the water gallery 13 are relatively small. A hole portion 14 in FIG. 2 is an air vent passage for a cylinder head coolant inlet portion. Therefore, the flow amount of the coolant inflowing through the portion of the coolant inflow opening 11 that is close to the intake port 21 and reaching the water gallery 13 without flowing through the vicinity of the exhaust port 31 is small. The first coolant passage 10 is formed so that most of the coolant inflowing through the portion of the coolant inflow opening 11 that is close to the exhaust port 31 (portion situated leftward of the intake port 21 in FIG. 3) first flows through the vicinity of the exhaust port 31, then flows through the portion between the valves of the intake ports 21, and then reaches the water gallery 13.

Thus, the flow amount of the coolant flowing through the vicinity of the exhaust port 31 and then through the vicinity of the intake port 21, and reaching the water gallery 13, is larger than the flow amount of the coolant flowing through the vicinity of the intake port 21 without flowing through the vicinity of the exhaust port 31 and reaching the water gallery 13. The water gallery 13 is formed at a portion which is above the intake port 21 and close to the outer opening 21*b* of the intake port 21 such that it extends substantially symmetrically with respect to the center line f1 and in the direction of the center line f2 (in the direction of the crank shaft).

The coolant discharge opening 12 of the first coolant passage 10 is formed in the outer face of the cylinder head H1, above the water gallery 13, and substantially on the center line f1 such that it communicates with the water gallery 13. The water gallery 13 is a space into which the coolant which has finished heat exchange with the cylinder head H1 is gathered just before it is discharged through the coolant discharge opening 12.

While in this embodiment, the water gallery 13 is substantially symmetric with respect to the center line f1, it is not necessarily symmetric so long as heat balance is not significantly degraded.

As shown in FIG. 2, the water gallery 13 is formed above the intake port 21, inwardly of the outer opening 21*b*, and laterally of the cam chamber 43 (close to the outer opening 21*b* of the intake port 21). The water gallery 13 is formed between the intake port 21 and the cam chamber 43 by utilizing their respective walls. More specifically, the water gallery 13 and the cam chamber 43 are separated from each other by a portion 43*a* of the wall defining the cam chamber 43, which is close to the intake port 21.

In the portion of the first coolant passage 10 from the coolant inflow opening 11 to the water gallery 13 (including the water gallery 13), the water gallery 13 is formed at a portion of the first coolant passage 10 that is closest to a top portion of the cylinder head H1. That is, the water gallery 13 is formed at the uppermost portion of the first coolant passage 10 except a portion close to the coolant discharge opening 12. Because the cylinder S1 is inclined, the water gallery 13 is positioned at a portion particularly higher than the other portions and compactly formed.

The coolant discharge opening 12 formed in the outer face of the cylinder head H1 and above the water gallery 13 such that it communicates with the water gallery 13 is situated closer to the top portion of the cylinder head H1 than the outer opening 21*b* of the intake port 21. The coolant discharge opening 12 is opened upwardly in a substantially vertical direction.

The center point of the coolant discharge opening 12 is situated on the center line f1 as described above. The reason why the coolant discharge opening 12 can be formed in such a portion is that the water gallery 13 is situated above the intake port 21. In other words, the coolant discharge opening 12 can be formed without being influenced by the intake port 21.

When the coolant discharge opening 12 is positioned above the intake port 21, the portion in which the coolant discharge opening 12 is to be formed can be thus selected with certain degree of freedom, although the center point of the coolant discharge opening 12 is not necessarily situated on the center line f1.

How the head cooling passage structure so configured functions will be described below.

The coolant flows into the first coolant passage 10 of the cylinder head H1 from the second coolant passage 50 of the cylinder S1 through the coolant inflow opening 11. The first coolant passage 10 passes through the vicinities of the intake port 21, the exhaust port 31, and the ignition plug 44.

As mentioned previously, the flow amount of the coolant flowing through the vicinity of the exhaust port 31 and through the vicinity of the intake port 21, and reaching the water gallery 13 is larger than the flow amount of the coolant flowing through the vicinity of the intake port 21 without flowing through the vicinity of the exhaust port 31, and reaching the water gallery 13. In other words, most of the coolant flowing into the first coolant passage 10 through the coolant inflow opening 11 first cools the high temperature portions and then flows toward the intake ports 21. Therefore, difference in temperature between the portion in the vicinity of the exhaust port 31 and the portion in the vicinity of the intake port 21 of the cylinder head H1 becomes small and distortion of the cylinder head H1 due to difference in heat expansion can be reduced.

As mentioned previously, the center point of the coolant discharge opening 12 is situated on the center line f1. Also, the water gallery 13 is substantially symmetric with respect to the center line f1, and the flow passages of the first coolant passage 10 from the coolant inflow opening 11 to the water gallery 13 are substantially symmetric with respect to the center line f1. Thus, the entire first coolant passage 10 extending from the coolant inflow opening 11 to the coolant discharge opening 12 is substantially symmetric with respect to the center line f1. Therefore, the flow lines of the coolant are substantially symmetric with respect to the center line f1. For this reason, temperature distributions of the cylinder head H1 are substantially symmetric with respect to the center line f1. That is, it is possible to avoid the problem that the temperature of one of areas separated by the center line f1 is by far higher than the temperature of the other area. As a result, distortion of the cylinder head H1 due to difference in heat expansion is small.

The coolant with elevated temperature resulting from heat exchange with the cylinder head H1 has a low density and tends to go upwardly. In the first coolant passage 10, the coolant is finally introduced to the water gallery 13. The water gallery 13 is situated at the uppermost portion of the first coolant passage 10 except the portion that is close to the coolant discharge opening 12. Therefore, the coolant which has the low density due to the elevated temperature flows toward the water gallery 13 by buoyancy of itself as well as a pressure from a water pump. In brief, the coolant is smoothly gathered into the water gallery 13 without remaining stagnant in the middle of the first coolant passage 10.

In some cases, bubbles are mixed into the coolant. If the bubbles remain stagnant in the middle of the first coolant passage 10, temperature is locally elevated at the corresponding portion, causing distortion of the cylinder head H1. On the other hand, in the head cooling passage structure of this embodiment, the water gallery 13 is situated at a high position and the bubbles are naturally gathered into the water gallery 13. Therefore, the bubbles do not remain stagnant in the middle of the first coolant passage 10.

Then, the coolant or the bubbles gathered into the water gallery 13 are discharged to the coolant pipe P through the coolant discharge opening 12. As described above, the coolant discharge opening 12 is opened upwardly in the substantially vertical direction. Therefore, the coolant or bubbles having buoyancy because of the elevated temperature are smoothly discharged to the coolant pipe P.

So far, one embodiment of the head cooling passage structure of the present invention has been described with reference to drawings.

According to this embodiment, the coolant or bubbles are less likely to remain stagnant in the coolant passage for cooling the cylinder head, and hence, the distortion of the cylinder head caused by local temperature increase due to such stagnancy can be avoided.

Since the degree of freedom at which the coolant discharge opening is formed is improved, the coolant discharge opening can be positioned to improve temperature balance.

The cylinder head can be compactly designed. In particular, since the water gallery is formed between the intake port and the side wall of the chamber formed in the cylinder head for accommodating the upper portion of the valve stems of the two intake valves, the side wall being closer to the intake port, the cylinder head can be more compactly designed.

Since the coolant passes through the portion between the two intake ports and outside of the two intake valves and is gathered into the water gallery spanning the two intake ports, cooling of the intake ports can be well-balanced.

Since the cylinder is inclined such that the intake valve is situated at a position higher than the position of the exhaust valve, the water gallery can be placed at a higher position and the coolant or bubbles are less likely to remain stagnant in the coolant passage.

In this embodiment, although the first coolant passage 10 is substantially symmetric with respect to the center line f1 over the entire passage from the coolant inflow opening 11 to the coolant discharge opening 12, the entire passage is not necessarily symmetric. For example, if at least the portion from the coolant inflow opening 11 to the water gallery 13 is substantially symmetric, then the temperature can be well-balanced with ease.

In this embodiment, the water gallery 13 is substantially symmetric with respect to the center line f1. However, the water gallery 13 is not necessarily symmetric so long as temperature balance of the cylinder head is not significantly degraded.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention.

What is claimed is:

1. A cylinder head cooling passage structure of an overhead cam type engine comprising:

a cylinder head;

two intake valves; and an exhaust valve, wherein the two intake valves are provided in the cylinder head such that the intake valves are substantially symmetric with respect to a plane that includes a center axis of a cylinder of the engine and is orthogonal to a crank shaft;

the exhaust valve is provided in the cylinder head such that the exhaust valve is situated on an opposite side of the intake valves with respect to a plane that includes the center axis of the cylinder and is in a longitudinal direction of the crank shaft, intake ports associated with the intake valves and an exhaust port associated with the exhaust valve are formed in the cylinder head such that the intake ports extend in a direction substantially orthogonal to the crank shaft and reach one end side of the cylinder head and the exhaust port extends in the direction substantially orthogonal to the crank shaft and reaches the other end side of the cylinder head, a coolant passage is formed in the cylinder head, for passing coolant therethrough, the coolant passage has a coolant inflow opening formed in a bottom face of the cylinder head that is joined to a cylinder block of the engine and a coolant discharge opening formed in an outer face of the cylinder head, a water gallery is formed in the coolant passage such that the water gallery communicates with the coolant discharge opening, the water gallery is formed above the intake ports in a direction of the center axis of the cylinder, and the water gallery is a space into which the coolant which has finished heat exchange with the cylinder head is gathered just before it is discharged through the coolant discharge opening.

2. The cylinder head cooling passage structure according to claim 1, wherein the water gallery is formed such that it spans the two intake ports, and the coolant passage is formed so that the coolant passes through a portion between the two intake ports and outside of the two intake valves and is gathered into the water gallery.

3. The cylinder head cooling passage structure according to claim 1, wherein the coolant discharge opening is formed above the water gallery and on a substantially center line of the two intake valves.

4. The cylinder head cooling passage structure according to claim 1, wherein the water gallery is formed between the intake port and a side wall of a chamber formed in the cylinder head for accommodating an upper portion of valve stems of the two intake valves such that the water gallery is isolated from the chamber by the side wall, the side wall being closer to an outer opening of the intake port.

5. The cylinder head cooling passage structure according to claim 1, wherein the center axis of the cylinder is inclined such that the intake valves are situated at a position higher than the position of the exhaust valve.

6. A cylinder head cooling passage structure of an overhead cam type engine comprising:

a cylinder head;

two intake valves; and an exhaust valve, wherein the two intake valves are provided in the cylinder head such that the intake valves are substantially symmetric with respect to a plane that includes a center axis of a cylinder of the engine and is orthogonal to a crank shaft;

the exhaust valve is provided in the cylinder head such that the exhaust valve is situated on an opposite side of the intake valves with respect to a plane that includes the center axis of the cylinder and is in a longitudinal direction of the crank shaft, intake ports associated with the intake valves and an exhaust port associated with the exhaust valve are formed in the cylinder head such that the intake ports extend in a direction substantially orthogonal to the crank shaft and reach one end side of the cylinder head and the exhaust port extends in the direction substantially orthogonal to the crank shaft and reaches the other end side of the cylinder head, a coolant passage is formed in the cylinder head, for passing coolant therethrough, the coolant passage has a first passage, a second passage, a water gallery, a coolant inflow opening, and a coolant discharge opening, the first passage is formed to pass through a portion between the two intake ports, the second passage is formed to pass through outside of the two intake valves, the water gallery allows the first passage and the second passage to communicate with each other and is formed above the intake ports in a direction of the center axis of the cylinder, the coolant inflow opening is formed in a bottom face of the cylinder head that is jointed to a cylinder block of the engine, the coolant discharge opening is formed above the water gallery and in an outer face of the cylinder head, and the coolant flowing from the coolant inflow opening into the coolant passage passes through the first passage and the second passage and is gathered into the water gallery and discharged to outside of the cylinder head through the coolant discharge opening.

7. The cylinder head cooling passage structure according to claim 6, wherein the coolant discharge opening is opened upwardly.

8. The cylinder head cooling passage structure according to claim 6, wherein the water gallery is formed between an outer opening of the intake port and a side wall of a chamber formed in the cylinder head for accommodating an upper portion of valve stems of the two intake valves, the side wall being closer to an outer opening of the intake port.

9. The cylinder head cooling passage structure according to claim 8, wherein the water gallery is isolated from the chamber by the side wall.

* * * * *